US005833087A

United States Patent [19]

Pfeiffer

[11] Patent Number: 5,833,087

[45] Date of Patent: Nov. 10, 1998

[54] BUTTON-TYPE TAMPER INDICATING METAL CLOSURE

[75] Inventor: Anthony J. Pfeiffer, Chicago, Ill.

[73] Assignee: White Cap, Inc., Downers Grove, Ill.

[21] Appl. No.: 331,020

[22] Filed: Oct. 28, 1994

[51] Int. Cl.[6] ..... B65D 55/02

[52] U.S. Cl. ..... 215/230; 215/270

[58] Field of Search ..... 215/230, 269, 215/270, 271, 262; 29/17.2; 72/384; 413/8, 56; 220/214, 305

[56] References Cited

U.S. PATENT DOCUMENTS

| | | | |
|---|---|---|---|
| 2,227,524 | 1/1941 | Williams | 413/56 X |
| 2,763,228 | 9/1956 | Lawson | 72/348 X |
| 3,152,711 | 10/1964 | Mumford et al. | 215/271 |
| 3,369,689 | 2/1968 | Dodge . | |
| 4,533,059 | 8/1985 | Kapolas et al. | 215/271 X |
| 4,790,705 | 12/1988 | Wilkinson et al. | 413/56 X |
| 5,016,769 | 5/1991 | Heilman | 413/8 X |
| 5,022,545 | 6/1991 | Carson | 215/230 |
| 5,119,963 | 6/1992 | Heilman | 215/230 |
| 5,149,238 | 9/1992 | McEldowney et al. | 413/8 |

*Primary Examiner*—Sue A. Weaver
*Attorney, Agent, or Firm*—Lockwood, Alex, FitzGibbon & Cummings

[57] ABSTRACT

A tamper indicating closure cap for a vacuum sealed container includes a metal end panel, a rim portion formed in the outer margin of the end panel and a skirt depending from the rim portion. The metal end panel includes a central tamper indicating area comprising a tamper indicating button and a generally concave shaped annular region extending radially outwardly toward the rim portion. The tamper indicating area is adapted to defect axially between a non-tamper indicating position and a tamper indicating position.

4 Claims, 2 Drawing Sheets

BUTTON-TYPE TAMPER INDICATING METAL CLOSURE

BACKGROUND AND DESCRIPTION OF THE INVENTION

The present invention is directed in general to useful improvements in closures having buttons for indicating the sealed condition of containers, and, more particularly, a metal closure having a central tamper indicating button drawn down by a vacuum formed within the associated container and having an improved end panel which has inherently lower stresses and produces greater panel deflection under vacuum.

In the past tamper indicating closures have been provided which included a central button disposed in the end panel of the closure that is drawn down by a vacuum created in an associated container. When the closure is initially opened, the vacuum is released residual forces in the closure cause the button to move axially upward creating a "popping" noise. The axial movement and noise provide a visual physical indication as well as an audible indication to the consumer that the product has not previously been opened. Other closures of this type have also included irreversible color change systems on the end panel are activated when the closure is initially opened.

In accordance with an important aspect of the present invention it is generally considered more desirable to provide a closure that produces a louder pop and greater panel deflection under vacuum of the tamper indicating button. With a greater deflection of the button and a louder pop or sound generation there is a greater probability that consumers will be aware that a product is safe or has not been tampered with and condition consumers to be cognizant of and listen for the sound of the tamper indicating button as well as look for and possibly feel deflection of the button. It has also been found that greater flip energy in the button increases the effectiveness of the tamper indicating closure particularly when used in conjunction with an irreversible color change indicator.

For larger closures (generally over 43 mm in diameter), button function is typically not as severe a problem; however, prior art small mouth buttons formed by drawing plate stock present problems associated with 1) high stress concentrations in the panel button area; 2) stiff panels which do not deflect under standard vacuum pressure; 3) deflection of the end panel originating from the center of the end panel; 4) high button downflips and return flips and low return flip sound.

In accordance with an important aspect of the present invention, these limitations associated with the prior art vacuum actuated button closures have been substantially eliminated by providing a new metal tamper evident closure having increased flip energy which thereby produces a louder pop when the closure is removed from the container and the vacuum is released.

It is therefore a principal object of the present invention to provide an improved vacuum tamper evident metal closure having a vacuum activated tamper indicating button.

Another object of the present invention is to provide a vacuum metal tamper evident closure that has increased end panel deflection under vacuum, wherein the increased panel deflection reduces the amount of vacuum necessary to draw the end panel and button into its downward state.

Still another object of the present invention is to provide a vacuum metal tamper evident closure that has lower inherent panel button stresses.

Another object of the present invention is to provide a method for forming a vacuum metal tamper evident closure according to the present invention.

The foregoing and other objects and advantages of the invention are practiced by providing a closure cap for a vacuum sealed container wherein the closure cap includes a metal end panel, a rim portion and a skirt depending from the rim portion. The metal end panel includes a central tamper indicating area made up of a tamper indicating button and a generally concave shaped annular region extending radially from the tamper indicating button to the rim portion.

For a complete understanding of the present invention reference is now made to the embodiment in greater detail in the accompanying drawings and described below by way of example. It should be understood that this invention is not limited to the particular embodiments illustrated herein but is defined by the appended claims.

IN THE DRAWINGS

Figure 4A:
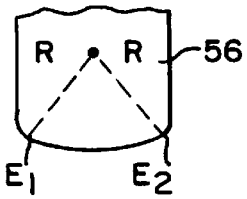
FIG. 4 is a side sectional view of a metal tamper indicating closure and flipper pad made according to the present invention illustrating the method of making same.
Figure 5:
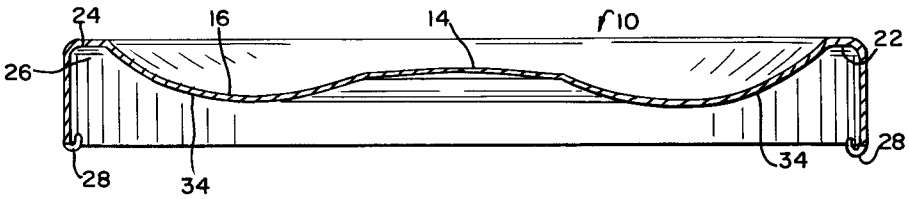
Figure 6:
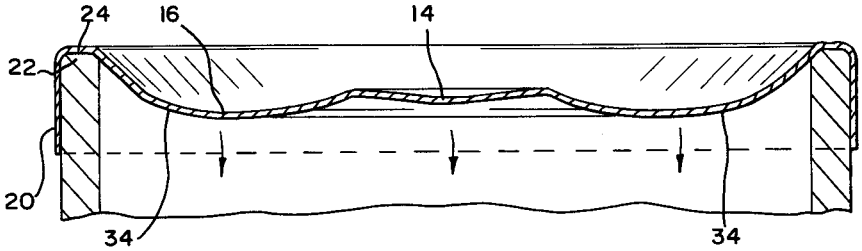
Figure 7:
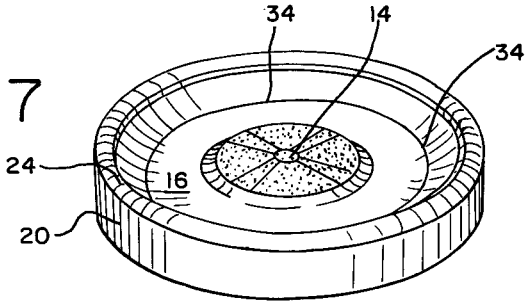

FIG. 4*a* is a front elevational view of an alternative embodiment of a flipper pad made according to the present invention;

FIG. 5 is a side sectional view of a closure made according to the present invention illustrating the as formed position of the tamper indicating area;

FIG. 6 is a side sectional view of a metal tamper indicating closure made according to the present invention (depicted for illustrative purposes only without a gasket) the tamper indicating area displaced axially downwardly; and, FIG. 7 is a perspective view of a metal tamper indicating closure utilizing a color change system in the tamper indicating button area.

DETAILED DESCRIPTION OF THE PREFERRED EMBODIMENT

Figure 1:
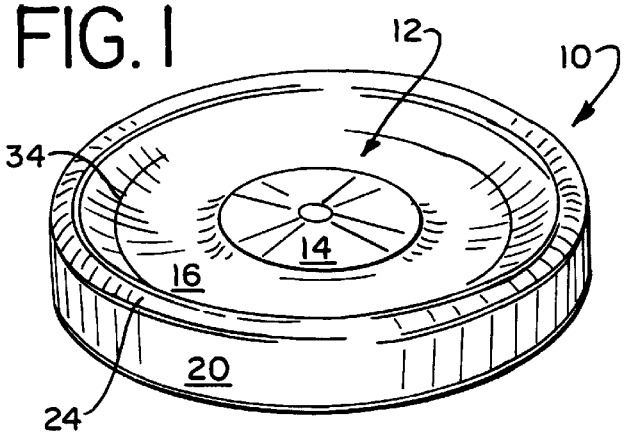
FIG. 1 is a perspective view of a metal tamper indicating closure made according to the present invention illustrating the generally concave shaped annular region of the end panel extending radially outward from the tamper indicating button.
Figure 4:
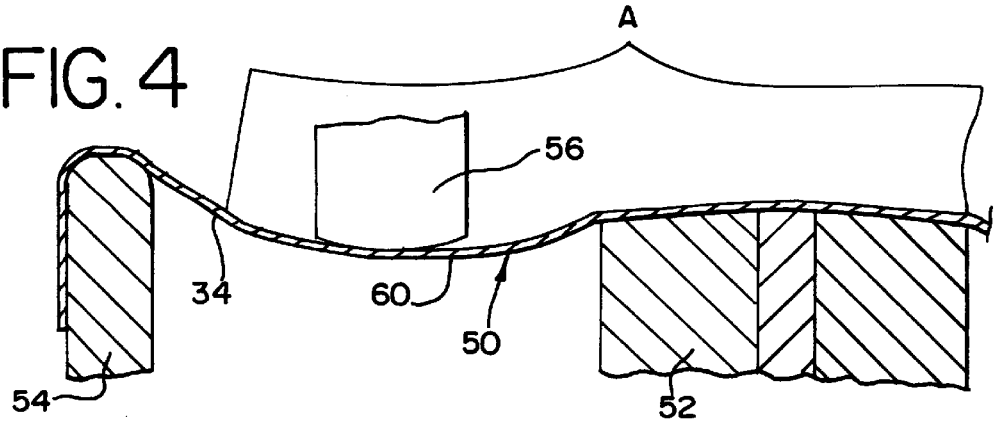

Referring now to the drawings in detail, a metal tamper indicating closure formed in accordance with the present invention is illustrated in FIGS. 1, 4 and 5. The closure is generally identified by the numeral 10 and is in the form of a closure cap which is formed of a suitable metal. Closure cap 10 generally includes an end panel 12 having a tamper indicating button 14 which extends radially into a concave shaped annular region or annulus 16 and further extends into a rim portion 22 (having a generally flat upper surface 24) which rim portion, in-turn, extends into a vertically depending skirt 20. As shown, a downwardly opening channel is defined by the upper portion of skirt 20, rim portion 22 and the outer peripheral portion of the annular region 16 of end panel 12. A suitable sealing compound 26 for sealingly securing the closure to a container may be disposed in the channel as illustrated in FIG. 5.

In the illustrated embodiment, skirt 20 of the closure includes an inwardly directed curl 28 at its lower free end and further includes at least two spaced locking lugs (not shown) of a type well known in the art. This type of closure is intended to be applied to a neck finish of an associated container. The associated container is generally provided with conventional locking pads or partial threads (not shown) corresponding in number and spacing to the locking lugs on the skirt 20 for mechanically securing the closure to the container. Alternatively, the skirt of the closure may include threaded portions adapted to cooperate with similarly styled threaded portions on the neck of a container thereby securing the closure to the container. It should be noted that a variety of configurations are available for securing a closure with a depending skirt to an associated container, and the present invention should not be limited to only those attachment mechanisms described herein.

In accordance with an important aspect of this invention, the end panel 12 is of a specific configuration including a central button 14 which is defined by a radially outwardly extending concave shaped annular region 16 integral with the central button. The concave shaped region 16 is in turn integral with the annular surface of the downwardly opening channel or rim 22. As shown in FIG. 6, when the cap is placed on a container and a vacuum is produced in the container, the central button 14 is deflected axially downwardly by the vacuum.

Figure 3:
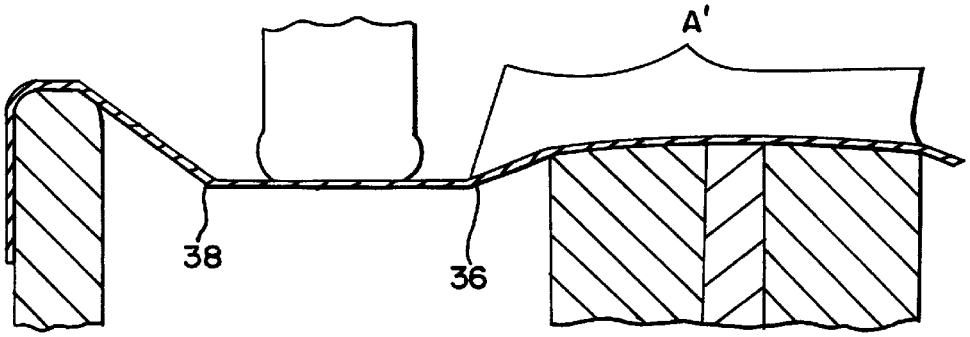
FIG. 3 PRIOR ART
FIG. 3 is a side sectional view of a prior art tamper indicating closure and flipper pad illustrating a prior art method of forming same.

In the past, as illustrated in FIG. 3, the deflection of the end panel originated at a sharply defined point 36 spaced substantially adjacent the button area. In addition, a second sharply defined annular portion 38 was located substantially adjacent the rim portion 22 of the closure. The annular portion of the end panel between points 36 and 38 was substantially planar producing a great stress concentration in the button area. This arrangement often produced a stiff metal end panel that would not deflect under vacuum.

The deflection of the end panel 12 in the closure made according to the present invention originates from the a portion of the concave shaped region 16 and as such has no precisely defined hinge point as does the prior art. Referring to FIGS. 3 and 4, it is apparent that in similarly sized closures, the area of the panel deflected (shown as A in FIG. 4 and A' in FIG. 3) is significantly greater in the closure made according to the present invention when compared to the prior art closure of FIG. 3. Such an area of deflection was previously only attainable in much larger closures.

The present invention can be particularly advantageously employed in closures having a diameter generally from 27 to 51 mm, however, other sized closures can also benefit therefrom. Extending the portion of the end panel that moves axially decreases the stress inherent in the button and simulates the end panels of much larger conventional closures. This is due to the fact that there is no given hinge point in the end panel and the entire concave region acts as a spring for the button area. The present invention eliminates the problem of the prior art closures where the rigidly defined hinge points created a stiff non deflecting end panel under vacuum. The present invention also reduces the button downflips or the amount of vacuum necessary to deflect the panel downwardly. In addition, the increased panel deflection produces a higher or louder button return flip sound as compared to the prior art closures. For example, it has been found that a typical commercial 40 mm cap requires a pulling vacuum in the range of 19–21" Hg to downflip a button. If a 0.312 inch diameter steel ball bearing (2.0 g) is placed in the center of a down-flipped button and the vacuum is released, the height the ball bearing travel provides an indication of the flip energy. In the typical commercial prior art 40 mm closure the ball bearing travels approximately 2 inches.

By contrast, in closures embodying the present invention the flip energy is increased such that the steel ball bearing traveled approximately 3.5 to 4 inches. Energy to downflip the button is also decreased by approximately 4 to 5 inches Hg. In addition, the button noise is increased in accordance with this invention to a range of between 138–140 dba.

In many applications, it is preferred that the center button be positioned such that on its return flip it remains approximately 0.005 to 0.01 inch below the top surface of the rim 18 for optimum results. In operation, the closure is fitted on a container wherein a vacuum is created moving the button axially downward. Upon initial removal of the closure, the vacuum is released springing the button axially upwardly and producing a popping noise. It should be understood that the entire end panel is moved axially although the movement is significantly greater in the button area.

As noted above, the closure constructed according to the present invention reduces high stress concentrations in the end panel and button area and increases the area of panel deflection. Closures having tamper indicating button areas which move axially downwardly when a vacuum is created on an associated container and spring upwardly to a extended position when the vacuum is released have generally been formed by drawing metal over variously positioned pads to form the contour of the closure and particularly the button and end panel. Prior art methods for forming closures included drawing plate stock across a flipper pad and the button pads as well as a center block as shown in FIG. 3 to form a closure. This prior art method produced high stress concentrations in the panel button area. In addition, precisely defined hinge points 36, 38 were created restricting the deflectability of the end panel.

In accordance with an important aspect of the present invention, the closure of the present invention is preferably formed by a stamping process. Plate stock 50 of a type well known in the art is held in place and engages a button forming pad 52 and a center block forming pad 54 on one surface of the plate stock while a constant spherical radius flipper pad 56 lightly stamps the opposite surface of the plate stock between the button pad and the center block pad forming the button tamper indicating button 14, the concave shaped annular region 16, the rim 22 as well as the downwardly depending skirt. Forming the skirt, the rim and button area by drawing plate stock over forming pads is well known in the art. However, as can be appreciated as an important feature of the present invention, the flipper pad 56 utilized is preferably configured with predetermined constant spherical radius contact area 60 for stamping the plate stock between the button pad and the center block pad.

Figure 2:
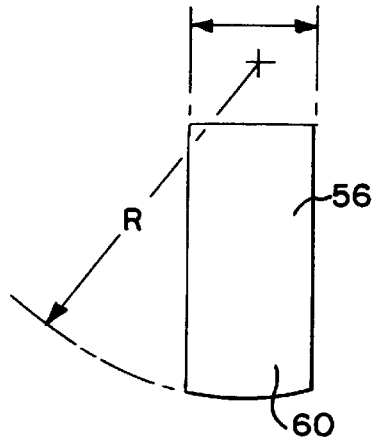
FIG. 2 is a front elevational view of a flipper pad having a constant spherical radius contact surface utilized in forming a closure of the present invention.

The flipper pad 56 utilized to make the present invention is constructed, in general, similar to conventional flipper pads. However, as shown in FIG. 2 the contact area 60 of the flipper pad 56 is provided with a spherical radius R of constant magnitude. Results have been obtained wherein the closure formed in accordance with the present invention utilized a flipper pad with a constant spherical radius in the range of between 0.125 inch and 0.375 inch. However, it is believed that a flipper pad having a spherical radius in the range of 0.1 inch or less to 0.45 inch or more will also produce closures in accordance with the present invention. Although it is preferred that a constant spherical radius extend over the entire contact area of the flipper pad, a closure in accordance with the present invention may be produced by a flipper pad having a constant spherical radius only at its edges, as identified by $E_1$ and $E_2$ in FIG. 4A.

Similarly, improved results have been obtained forming closures in accordance with the present invention from a flipper pad having a width of 0.05 inch to 0.150 inch. It is believed that a flipper pad having a width in the range of 0.03 inch to 0.25 inch will also produce an improved closure in accordance with the present invention. Closures formed utilizing the flipper pad 56 described above reduce inherent stress in the end panel as described above.

It should also be understood that the present invention and method for making same may be used on conventional, contour, faceted or any other button profiles to increase the panel deflection and return flip sound. The closure of the present invention as shown in FIG. 7 may also be used with a permanent color change mechanism in the button area of a type known in the art.

Although certain preferred embodiments of the invention have been specifically illustrated and described herein, it is to be understood that minor variations may be made in the construction of the closure and tamper indicating features utilized in conjunction therewith without departing from the spirit and the invention is limited only by the scope of the appended claims.

I claim:

1. A tamper indicating closure cap for a vacuum sealed container, said closure having a top surface and comprising:

a metal end panel having a centrally located tamper indicating button adapted to axially deflect between an uppermost tamper indicating position and a lowermost position indicating the presence of a vacuum in a container sealed with said closure cap, an outer peripheral portion of said tamper indicating button extending radially outwardly into an innermost portion of an annulus, an outermost peripheral portion of said annulus being surrounded by a rim, said annulus being integrally formed with each of said tamper indicating button and said rim, an outer edge of said rim extending axially downwardly into a depending skirt, said annulus having a substantially uniform arcuate cross-sectional configuration throughout its circumferential length which configuration in its as-formed condition is concave in shape with respect to said outer peripheral portion of said tamper indicating button and said rim, said annulus being free of sharply defined bends, and said tamper indicating button in its as-formed condition continuously extending downwardly from a center portion thereof to said outer portion thereof.

2. A tamper indicating closure cap according to claim 1 wherein said top surface of said rim is generally flat and said tamper indicating button in its uppermost tamper indicating position is from approximately 0.005 to 0.01 inch below said flat top surface of said rim.

3. A tamper indicating closure cap according to claim 2 wherein said skirt has a nominal internal diameter of from approximately 27 mm to 51 mm.

4. A tamper indicating closure cap according to claim 1 wherein said concave shaped annulus extends continuously without interruption between said tamper indicating button and said rim.

* * * * *